US005175393A

United States Patent [19]

Andersson

[11] Patent Number: 5,175,393

[45] Date of Patent: Dec. 29, 1992

[54] DEVICE IN A LAUNCH UNIT FOR A MORTAR PROJECTILE

[75] Inventor: Bernt Andersson, Eskilstuna, Sweden

[73] Assignee: Swedish Ordnance - FFV/Bofors AB, Karlskoga, Sweden

[21] Appl. No.: 828,570

[22] Filed: Jan. 31, 1992

[30] Foreign Application Priority Data

Jan. 31, 1991 [SE] Sweden ..... 9100300

[51] Int. Cl.[5] ..... F42B 15/00

[52] U.S. Cl. ..... 102/373; 102/372

[58] Field of Search ..... 102/373, 372, 430, 439; 89/1.35

[56] References Cited

U.S. PATENT DOCUMENTS

| | | | |
|---|---|---|---|
| 2,447,971 | 8/1948 | Weinert | 102/483 |
| 2,901,973 | 9/1959 | Donner | 102/372 |
| 3,915,091 | 10/1975 | Smith et al. | 102/373 |
| 4,593,620 | 6/1986 | Pettersson et al. | 102/372 |
| 4,611,540 | 9/1986 | Pettersson et al. | 102/372 |
| 4,665,825 | 5/1987 | Pettersson | 102/372 |

*Primary Examiner*—David H. Brown
*Attorney, Agent, or Firm*—Keck, Mahin & Cate

[57] ABSTRACT

A device in a launch unit for a mortar projectile (4), where the launch unit (6) has a propellant charge (10) capable of generating propellant gas for launching the projectile from the barrel (1) of the mortar, the launch unit being designed to be placed in a loading position behind the projectile. The launch unit has an enlarged cross surface (20*a*) in the barrel against the pressure from the propellant gas, the enlarged cross surface creating an expulsion force on the launch unit. The cross surface is in the form of wing elements (20*a*) arranged crosswise in the front portion of the launch unit (6) and being bendable in proportion to the magnitude of the propellant gas pressure in order to accomplish a self-regulation of the expulsion velocity of the launch unit.

3 Claims, 3 Drawing Sheets

DEVICE IN A LAUNCH UNIT FOR A MORTAR PROJECTILE

FIELD OF THE INVENTION

The present invention relates to a device in a launch unit for a mortar projectile, where the launch unit has a propellant charge capable of generating propellant gas for launching the projectile from a barrel of the mortar, the launch unit being designed to be placed in a loading position behind the projectile in the barrel.

BACKGROUND ART

Such a device in a launch unit is known from SE-A-444,726. With the known device there is the problem of removing the used launch unit from the barrel after launch of the projectile in order to enable the mortar to be re-loaded. Hitherto, no wholly satisfying solution to this problem has been proposed.

SUMMARY OF THE INVENTION

The object of the invention is, therefore, to provide a device in a launch unit of the kind mentioned by way of introduction, which causes an automatic and assured removal of the used launch unit from the barrel simultaneously with, or soon after the launch of the projectile from the barrel.

Further developments of the invention are set forth in the depending claims.

PREFERRED EMBODIMENT

Figure 1:
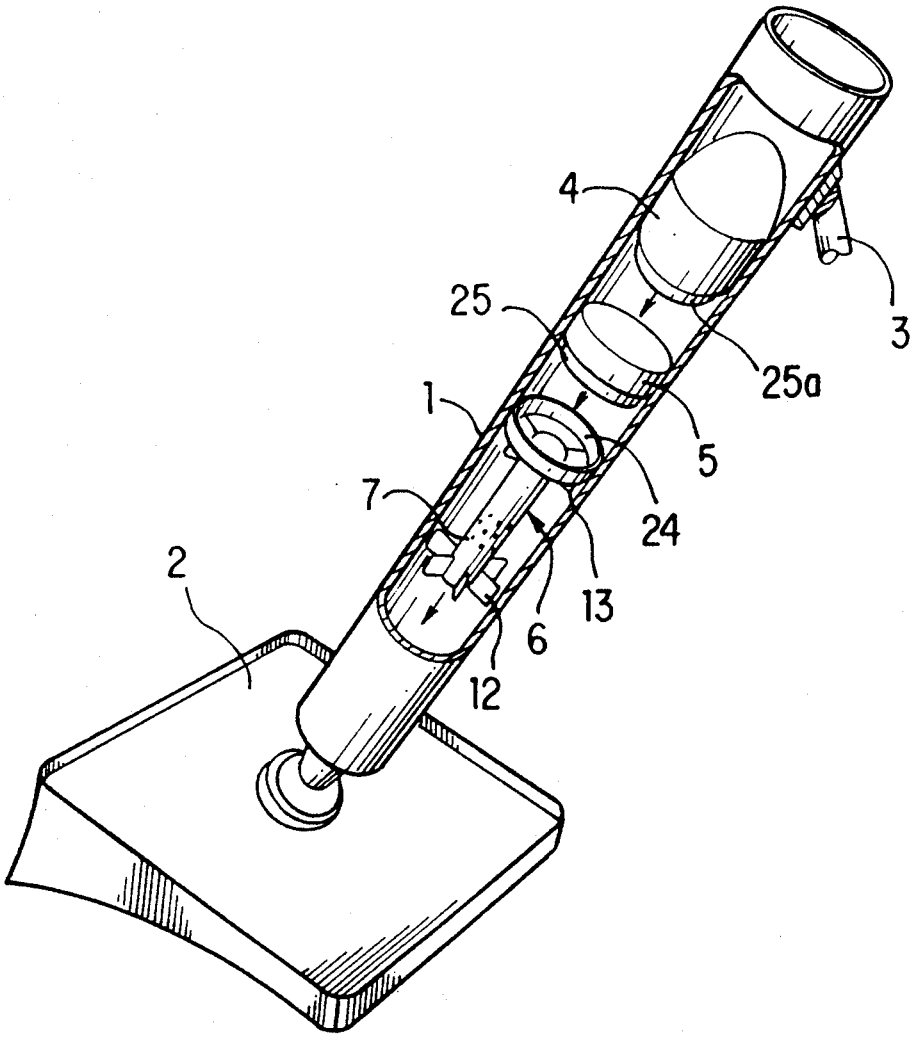
FIG. 1 is a perspective view of a mortar, wherein the barrel has been partially opened in order to show the manner in which the launch unit, provided with a device according to the invention, and a propulsion means and a projectile body can be loaded separately into the barrel.

The mortar illustrated in FIG. 1 comprises a barrel 1, preferably with a smooth bore, a base plate 2 and a cradle 3, only a suggestion of which is given in the figure. The associated shell ammunition consists, in the embodiment shown, of a shell which consists of a projectile body 4 containing amongst other things an active load (not illustrated) such as a warhead, and a propulsion means 5, the latter also being called a sustainer. Reference numeral 6 denotes a launch or propulsion unit with a device in accordance with the invention, shown in more detail in FIG. 2.

The warhead may, for instance, comprise an explosive charge with a hollow-charge effect. Since such explosive charges are already generally familiar as such, it is not considered necessary to describe them in any more detail. The sustainer 5 is also a component which is well known to those skilled in the art, for which reason it is not described here in any greater detail. The sustainer 5 can be docked against the projectile 4 by means of a conventional (and therefore not described) docking mechanism under the influence of the launch forces created by the mortar.

The projectile body 4 is provided with folded stabilizing fins (not illustrated) of the type known as wraparound fins, which are arranged to unfold in known manner when the projectile has left the barrel.

For drafting purpose the projectile body 4 is shown in FIG. 1 to be of relatively short length, whereas its length will normally be very much greater than its calibre. FIG. 1 illustrates how the projectile body 4, the sustainer 5 and the launch unit 6 move downwardly in the barrel 1 to a loading position at the bottom of the barrel.

Figure 2:
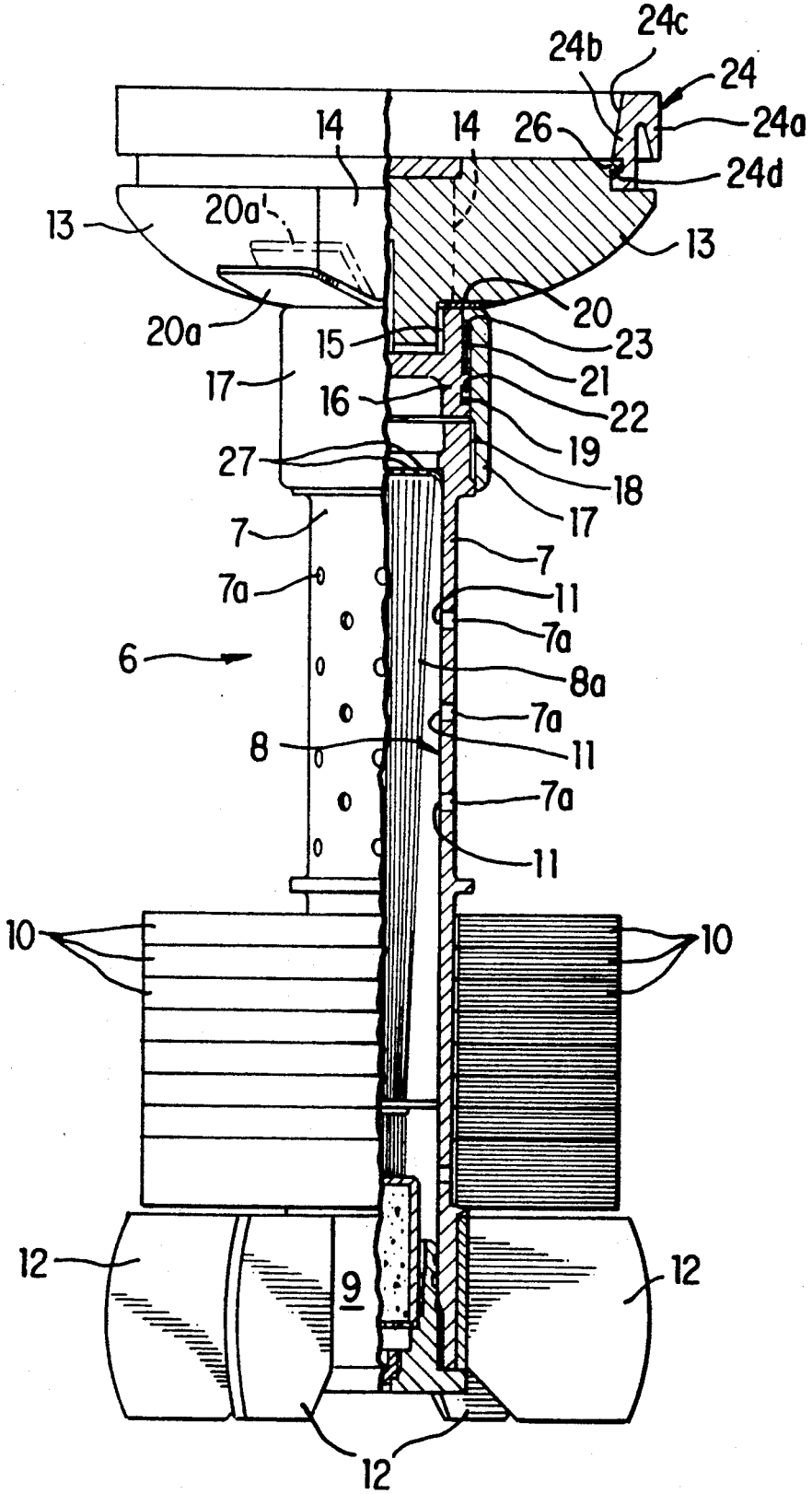
FIG. 2 is a longitudinal view on an enlarged scale, partly in section, of the launch unit according to FIG. 1.

The launch unit 6 comprises a cylindrical cartridge tube 7, see FIG. 2, which, in a known way, houses a propellant cartridge 8 with an internal powder charge in the form of powder strips 8*a*, intended to be ignited by an ignition device 9 located at the bottom of the cartridge tube. The ignition device is of conventional type, not described in greater detail here, including ignition charge and primer. The wall of the cartridge tube 7 has a plurality of through holes 7*a* for exhausting powder gas to an external propellant charge for the propulsion of the projectile and consisting of a plurality eight in the embodiment shown) of conventional increment powder charges 10, which are placed around the cartridge tube, and the number of which depends upon the desired range of the projectile. (For drafting purposes the increment charges 10 are not illustrated in FIG. 1). Powder gases from the powder strip 8*a* will, at a predetermined gas pressure in the propellant cartridge 8, break weakened zones 11 in its wall in register with the holes 7*a* such that the powder gases can be exhausted therethrough to ignite the propellant charge 10 which will provide sufficient propellant gases for lauching the sustainer 5 and the projectile 4 out of the barrel 1.

The launch unit 6 is centered in the barrel 1 by means of six rear and four front centering fins 12 and 13, respectively. The rear centering fins 12 are secured in a star-shaped arrangement around the rear end of the cartridge tube 7. The front centering fins 13 are introduced into and retained inside grooves (not shown) in a support rivet 14 arranged axially in front of the cartridge tube 7 and being rigidly connected, via a joint 15, for instance a thread joint, to a piston 16 of a cylinder 17 which is arranged between the cartridge tube 7 and the rivet 14, said cylinder 17 being rigidly connected, via a joint 18, for instance a thread joint, to the cartridge tube 7. Reference numeral 19 denotes an O-ring which constitutes a sealing between the piston 16 and the cylinder 17.

In order to avoid that the piston 16 cuts into the fins 13 during its stroke, a pressure distribution disc 20 made from metal, such as steel or similar material, is held between the fins 13 and the piston 16. When tightening the support rivet 14 the fins 13 will be conveyed since they are held by the rivet 14, such that the fins 13 will be fastened against the disc 20.

The piston 16 is normally held stationary in the cylinder 17 by means of a deformable damping tube 21, for instance made from metal, interposed between an annular flange 22 of the piston 16 and an annular flange 23 of the cylinder 17. Thereby, the piston 16 can move within the cylinder 17 away from the cartridge tube 7 only upon compression of the damping tube 21. The length of the stroke of piston 16 is a few millimeters and is determined by the extent of compression of the damping tube 21.

A sealing means in the form of a girdle 24, which is intended to protect the front portions of the projectile body 4 from gases from the propellant charge 10, is secured to the front centering fins 13.

In accordance with a preferred embodiment the damping tube 21 is in one of its ends, which faces the piston 16, provided with axial slots having a length of about 1.5 millimeters to form axial flaps therebetween such that the compression of the damping tube 21 begins with a bending or a compression of these flaps thereby offering a free stroke of the piston 16 for about 1.5 millimeters before the piston 16 begins to deform the tube 21. During the time interval when the piston bends said flaps, the sustainer 5 will be given a velocity of about 3 m/sec. Any further deformation (compression) of the tube 21 caused by the piston 16 is used only to guarantee that the sustainer 5 (which, accordingly, has been given a certain velocity), does not leave the girdle 24.

The girdle 24, which may be made from a plastic, for instance, such as polytetrafluorethylene or a similar material, is a so-called lip girdle having an outer annular lip 24*a*, the outside of which is adapted to abut against the wall of the barrel 1, and an inner lip 24*b*, the inside 24*c* of which constitutes a seat for a mating conical shoulder 25 of the rear end of the sustainer 5. (A corresponding conical shoulder 25*a* is provided on the projectile body 4.)

The inner lip 24*b* has a recess 24*d* into which a hook 26 of the centering fins 13 is introduced and retained therein so as to accomplish a mechanical joint between the centering fins 13 and the girdle 24.

On firing the mortar, two consecutive powder gas stages will be formed, since the cartridge tube 7 has a number of front break zones 27 in register with the piston 16 on the one hand, and the above-mentioned lateral break zones 11 on the other hand. The front break zones 27 are dimensioned to break at a predetermined relatively low first gas pressure, for instance 2 MPa, in order to prepare the launch of the projectile from the barrel, whereas the break zones 11 are dimensioned to break at a predetermined second gas pressure which is substantially greater than said first gas pressure, for instance 20 MPa, in order to accomplish the final launch of the projectile out of the barrel.

Figure 3:
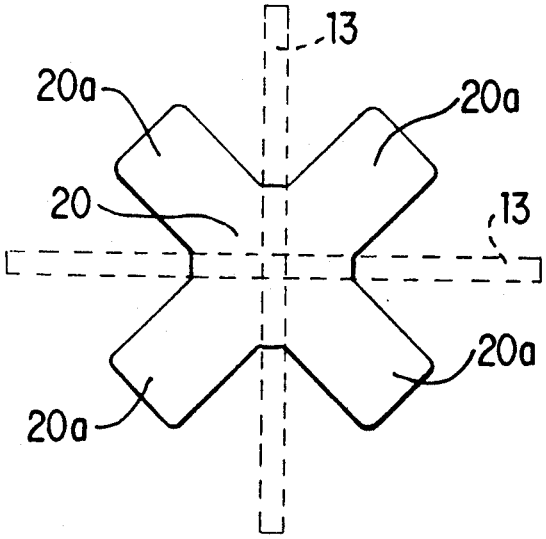
FIG. 3 is an end view of a disc incorporated in the launch device.

The pressure distribution disc 20, see FIG. 3, has four substantially rectangular wing elements 20*a* arranged crosswise relative to the longitudinal axis of the barrel, but possibly to some extent bent forwardly relative to said longitudinal axis, and being uniformly distributed around the disc 20 between the front centering fins 13, which are indicated in dotted lines in FIG. 3. The elements 20 thus form gas attack surfaces being exposed to the propellant gases acting on the projectile body 4.

The elements 20*a* are made from a metallic material having such an elasticity that the elements are capable of being bent forwardly, as is shown in dotted lines 20*a*' in FIG. 2, in response to the propellant gas pressure exerted on the elements 20*a* by the propellant gases from the charge 10. The elasticity of the wing elements 20*a* is chosen such that the extent of bending of the elements 20*a* will depend on the magnitude of the propellant gas pressure.

For drafting purposes the wing elements 20*a* are not shown in FIG. 1.

The function of the ammunition is as follows.

When the pressure in the propellant cartridge 8 has reached said first pressure as a response to the firing of the mortar, the break zones 27 will break, so that the propellant cartridge emits powder gases in a first phase (for preparing the launch of the projectile) at said lower gas pressure which affects the piston 16. The piston 16 and the centering fins 13 associated thereto will, therefore, move some millimeters forwardly by the action of the damping tube 21 as has been described above so that the centering fins 13 will force the girdle stronger against the shoulder 25 of the sustainer such that the girdle will be jammed thereto in order to achieve an improved sealing between the launch unit 6 and the sustainer 5. At the same time the sustainer 5 will receive a shock by the piston 16 and the fins 13, which will propagate further to a shock sensitive docking mechanism (not shown) between the sustainer 5 and the projectile body 4 so that the docking mechanism in a soft and gentle way at least begins the docking of the sustainer against the projectile body.

Only when said higher gas pressure has been built up in the propellant cartridge 8 the second powder gas phase will start, delayed in relation to the first powder gas phase, when the break zones 11 break so that powder gas can enter via the holes 7*a* of the cartridge tube 7 and ignite the external propellant charge 10 which generates propellant gas which affects the bottom of the sustainer 5 (or the projectile body 4 in case no sustainer is used) so that the docking between the sustainer and the projectile body is completed (in case the docking has not been completed during the first powder gas phase), such that these will together like one unit be expelled out of the barrel.

The prospellant gas powder pressure against the bottom of the sustainer (or against the bottom of the projectile in case no sustainer is used) causes the girdle lip 24*b* to break in register with the hooks 26. The girdle 24 will then, thanks to the gas pressure between the lips of the girdle, be jammed against the shoulder 25 of the sustainer (or against the shoulder 25*a* of the projectile in case no sustainer is used) during the time interval when the propellant gases affect the sustainer.

The girdle, preferably its outer lip 24*a*, has a number of pockets (not shown) which are open against the space between the lips so that the pockets will be filled by powder gas during the "barrel phase". The depth of the pockets is only slightly less than the thickness of the lip. The width of the pockets may be about 1 to 3 millimeters. When the shell has left the muzzle of the barrel and the propellant gas pressure has disappeared behind the shell, the powder gas in the pockets will be released so abruptly that the girdle will break and thus leave the sustainer (or the projectile).

The propellant gas pressure will also, as has been indicated above, affect the wing elements 20*a* causing these to be forced forwardly in the barrel conveying the entire launch unit 6. The wing elements 20*a* will thus ensure that the launch unit 6 will be thrown out of the barrel. Since the wing elements 20*a* are bendable in proportion to the magnitude of the propellant gas pressure they will bend more the higher the propellant gas pressure is, providing an automatic self-regulation of the expulsion velocity of the launch unit. This means that the launch unit will be expelled substantially the same distance from the barrel irrespectively if the propellant powder gas pressure is high or low.

The gas attack on the elements 20*a* is of course much more gentle than on the rearwardfacing end of the sustainer such that the launch unit will have a relatively low velocity so that it will be expelled only some tens of meters outside the barrel.

The expression projectile body used in this patent shall also be understood to denote such components providing a rearward extension of the projectile, for example propulsion motors (sustainers) of the aforementioned kind, as are capable of being connected to the rear of a projectile body.

I claim:

1. A device in a launch unit (6) for a mortar projectile (4), where said launch unit (6) has a propellant charge (10) capable of generating propellant gas for launching said projectile from a barrel (1) of said mortar, said launch unit being designed to be placed in a loading position behind said projectile in said barrel, characterized in that said launch unit (6) has a front portion provided with metallic wing elements (20*a*) which are arranged substantially crosswise relative to the longitudinal axis of said barrel (1) such that said wing elements will be exposed to the pressure from said propellant gas in order to generate an expulsion force on said launch unit.

2. A device according to claim 1, characterized in that said wing elements (20*a*) comprise a deformable metallic material and said wing elements are elastically deformable under the influence of said propellant gas pressure to establish a reduction of said expulsion force on said launch unit, wherein said reduction is dependent on the magnitude of said propellant gas pressure.

3. A device according to claim 1, characterized in that said launch unit (6) has a girdle means (24) forming a seat for a shoulder (25) of said projectile in said loading position, said girdle means being detachable from said launch unit on the one hand, and able to be simultaneously jammed against said shoulder on the other hand as a result of said propellant gas pressure acting on said girdle means.

* * * * *